US005913786A

United States Patent [19]

Mayer

[11] Patent Number: 5,913,786

[45] Date of Patent: Jun. 22, 1999

[54] WINDOW SASH

[76] Inventor: E. Howard Mayer, 209 Williamsburg Dr., Thiensville, Wis. 53092

[21] Appl. No.: 08/863,946

[22] Filed: May 27, 1997

Related U.S. Application Data

[63] Continuation-in-part of application No. 08/610,483, Mar. 4, 1996, and application No. 08/413,775, Mar. 30, 1995, abandoned, which is a continuation-in-part of application No. 08/161,129, Dec. 3, 1993, abandoned.

[51] Int. Cl.[6] ..... E06B 3/988

[52] U.S. Cl. ..... 52/204.7; 52/204.1; 52/204.5

[58] Field of Search ..... 52/202, 204.1, 52/204.5, 204.51, 204.593, 204.597, 204.6, 204.7, 206–208, 213, 215, 216, 786.1, 788.1, 656.5, 656.6, 656.7, 204.595

[56] References Cited

U.S. PATENT DOCUMENTS

| | | | |
|---|---|---|---|
| 2,029,541 | 2/1936 | Martinson . | |
| 2,173,649 | 9/1939 | Firner . | |
| 2,173,664 | 9/1939 | Shutts . | |
| 2,282,831 | 5/1942 | Shutts . | |
| 2,348,307 | 5/1944 | Richardson . | |
| 2,707,810 | 5/1955 | Bolte . | |
| 2,708,774 | 5/1955 | Seelen . | |
| 2,809,728 | 10/1957 | Olson . | |
| 2,869,187 | 1/1959 | Liebman et al. . | |
| 2,918,708 | 12/1959 | Sharp et al. . | |
| 2,934,801 | 5/1960 | Blaszkowski | 52/204.595 |
| 2,953,824 | 9/1960 | Minick . | |
| 3,111,726 | 11/1963 | Grossman . | |
| 3,256,641 | 6/1966 | Johnson | 52/204.597 X |
| 3,324,597 | 6/1967 | Rich . | |
| 3,420,026 | 1/1969 | Nolan . | |
| 3,861,444 | 1/1975 | Portwood | 160/90 |
| 4,004,629 | 1/1977 | Kelly | 160/90 |
| 4,109,432 | 8/1978 | Pilz et al. | 52/172 |
| 4,118,266 | 10/1978 | Kerr | 156/293 |
| 4,149,348 | 4/1979 | Pyzewski | 52/172 |
| 4,510,715 | 4/1985 | Giquere | 49/488 |
| 4,554,770 | 11/1985 | Anders | 52/207 |
| 4,599,825 | 7/1986 | Sixsmith | 49/466 |
| 4,674,246 | 6/1987 | Giquere | 52/207 |
| 5,131,194 | 7/1992 | Anderson | 52/144 |
| 5,184,423 | 2/1993 | McCarty | 49/501 |
| 5,194,309 | 3/1993 | Knudsen | 428/83 |
| 5,265,388 | 11/1993 | Sherwood | 52/213 |

FOREIGN PATENT DOCUMENTS

| | | |
|---|---|---|
| 222834 | 7/1959 | Australia . |
| 1420069 | 10/1965 | France . |

*Primary Examiner*—Beth A. Aubrey
*Attorney, Agent, or Firm*—James D. Welch

[57] ABSTRACT

Window sash frame systems which provide a groove for use in conveniently affixing various interfaces which interact with window frames, and/or other interfaces in use, are disclosed. A preferred version of the present invention window sash frame system is generally rectangular in shape, and includes two window panes within which are separated by an insulating void region, and has a groove in an outer surface, with the groove being appropriately shaped for receiving a rigid insertional lip of a selected interface. Present invention window sashes are preferably of single piece construction formed by a thermoplastic resin extrusion procedure. Also disclosed are prefered window frame systems for use with the window sash systems.

21 Claims, 8 Drawing Sheets

WINDOW SASH

The present Application is a Continuation-In-Part of co-pending Applications Ser. No. 08/610,483 filed Mar. 4, 1996 and 08/413,775 filed Mar. 30, 1995, now abandoned, which in turn a Continuation of Application Ser. No. 08/161,129 filed Dec. 3, 1993, now abandoned.

TECHNICAL FIELD

The present invention relates to window sashes, and more particularly to a window sash frame system which provides a circumscribing groove means for use in conveniently affixing thereto, various interface means which interface to window frames, and/or other interface means, in use. A preferred version of the present invention window sash is generally rectangular in shape, includes two window panes therewithin which are separated by an insulating void region, and has a circumscribing groove means in an outer essentially planar surface thereof, said circumscribing groove means being appropriately shaped for receiving a rigid insertional lip of a selected interface means. In use, various functionally effective window frame interface and/or other interface means are caused to be affixed to said window sash frame system along at least a portion of its outer circumference by insertion of a rigid insertional means into the circumscribing groove means. Present invention window sash frame systems are preferably of single piece construction formed by a resin transfer molding procedure.

BACKGROUND

The use of window frames and sashes in houses and buildings is well known. Typical construction of early window frames and sashes utilized wood, but attendant therewith were the problems of dry rot, warping and swelling. In an attempt to overcome such drawbacks inventors covered wood used in the construction of window frames with thin plastic extrusions. Such thin plastic extrusions served to delay warping and swelling, but actually tended to accelerate dry rot. A major advance was made with the introduction of aluminum window frames and sashes in that window frames and sashes made of aluminum are compact, and do not exhibit swelling, warping and dry rot, however, new problems presented. Said problems being sweating and associated high thermal conductivity. Attempts to overcome said sweating and high thermal conductivity problems included constructing window frames in which aluminum was utilized, wherein aluminum components were separated by thermally insulating wood. Another technique utilized plastic rails placed between aluminum elements. Such use of plastic led to fabricating window frames and/or sashes entirely therefrom. Plastic, however, is not as rigid as aluminum, hence, plastic extruded window frames tended to be bulky to provide sufficient strength. While the appearance of such bulky window frames and sashes is less than optimum, however, it should be appreciated that plastic has the benefit of not requiring periodic painting. It is noted at this point that present invention window sashes are produced by a resin transfer molding process, and comprise a more attractive, less bulky result, which incorporates thermal control and provides self contained wall trim, thereby enhancing ease of installation.

Inherent in the use of window frames and sashes is the interfacing of window sashes within window frames such that thermal insulating capabilities are achieved, while allowing window sashes to slide open and shut within said window frames.

A Search of Patents which relate to window frames and interfacing between window sashes and window frames has provided a Patent to Andars, U.S. Pat. No. 4,554,770. This Patent describes the use of small plastic buffers to reduce heat transfer in hollow aluminum frames. A primary purpose of the construction is to avoid gaps through which air might enter. A seal is provided between adjacent sashes by a separate removable intermediate interlocking rail.

Another Patent, to Gigeure, U.S. Pat. No. 4,674,246 describes a sliding window frame having two or more removable sash mounted therein, said window frame having head and sill made of thermally insulating plastic.

A French Patent to Armstadt, No. 1,420,069 describes a single glazed window in an aluminum frame without thermal breaks.

U.S. Pat. No. 3,324,597 to Rich describes a pair of window sash, one fixed and one slideable, with the two sash having leading edge interlocking weather strip flanges which may be interlocked on either side of the sash. The design focused on use in large size systems. Considerable separate finishing trim would apparently be required with the described system in practice.

A Patent to Nolan, U.S. Pat. No. 3,420,026 is disclosed as it describes an aluminum frame with thermal breaks. The focus is upon the use of thermal insulation to prevent or reduce condensation problems associated with metal frame windows or the like.

Another Patent, U.S. Pat. No. 3,111,726 to Grossman, describes window construction incorporating a horizontally slideable inner sash and an outer sash which is fixed. The frame involved is of multiple piece construction.

A Patent, U.S. Pat. No. 2,953,824 to Minick describes a system relating to window construction of the type including one or more fixed sash panels and one or more horizontally sliding sash panels all contained and supported within a frame in which all component sections (head, sill and side bar), are formed from extruded structural members.

U.S. Pat. No. 2,953,824 to Sharp describes a corner joint structure for application in sliding closure systems comprising a means for interconnecting a pair of frame members.

A Patent to Liebman et al, U.S. Pat. No. 2,869,187 describes a sliding type window construction comprising a metal frame.

A Patent to Vogelhut, Australian No. 222,834, describes a sliding door construction comprised of aluminum door panels, head, jamb and sill members.

U.S. Pat. No. 4,004,629 to Kelly describes a frameless sliding window assembly comprising a pair of jambs a header and a sill which are constructed from only two simple extruded shapes.

U.S. Pat. No. 3,861,444 to Portwood describes an extruded plastic window frame fabricated from extruded plastic components which are cut to length according to a given window size.

Finally, a Patent to Sherwood, U.S. Pat. No. 5,265,388 is disclosed as it describes a window frame assembly for mounting a window pane to a building. The outside and inside single piece construction frames each comprise radial projections which extend over outside and inside walls respectively. However, the window involved is not mounted in a slideable sash.

No known Patent describes various interface means affixed to a window sash, as taught by the present invention.

Continuing, with an eye to the present invention, a further Search of Patents which relate to sashes per se. was effected.

Representative Patents which describe window sashes per se. include that to Pyzewski, U.S. Pat. No. 4,149,348. This Patent describes a sash which provides an adhesive secured spacer between glass sheets mounted therein, to form an insulating dead space between said glass sheets. A similar system is described in a Patent to Blaszkowski, U.S. Pat. No. 2,934,801.

Another Patent, U.S. Pat. No. 4,109,432 to Pilz, describes a window sash comprising a multipane insulating, extruded glass rim strip which has insulating space between panes. A method of producing the Pilz system involves providing an extruded strip with two grooves along an inner surface thereof, causing ninety (90) degree notches to be present at locations along said extruded strip which correspond to pane corners, heat softening said corner regions of said extruded strip and causing said extruded strip to be bent so as to conform to the shape of the panes. There is no circumscribing groove present in an outer surface of said extruded strip however. A method of realizing "framing channel structures" which utilizes ninety (90) degree notches and forming of a frame to a glass pane is described in U.S. Pat. No. 2,809,728 to Olson.

Patents which describe the presence of a groove in an outer circumference of a window sash are U.S. Pat. No. 2,708,774 to Seelen; U.S. Pat. No. 2,282,831 to Shutts; U.S. Pat. No. 2,173,664 to Shutts; U.S. Pat. No. 2,173,649 to Firner and U.S. Pat. No. 2,348,307 to Richardson. Said Patents, however, do not describe the mounting of various functionally effective interface means in said groove, as in the present invention. Another Patent, U.S. Pat. No. 5,131,194 to Anderson, however, describes the presence of a groove in an outer surface of a window sash, into which groove is caused to be mounted an elastomeric foam gasket. It is specifically noted that the foam gasket is non-rigid, emphasis added. The Anderson system is directed to providing a sound barrier, however, and not to providing easily mountable various functionally effective interface means to a window sash, in use. In particular, the groove means is not designed to allow easy affixing of various fuctionally effective interface means in use, nor is the foam gasket insert of a sufficient strength to support attachment of structural interface means.

A Patent to Johnson, U.S. Pat. No. 3,256,641 describes the presence of a guide rail secured to a window frame jamb by means of an element inserted into a groove in said window frame jamb. A portion of a Johnson sash is, by flanges, formed to slideably conform to the shape of said guide rail. Weather stripping can also be retained by said portion of a Johnson sash which is formed by flanges. However, a groove circumferentially present around the outer surface of a sash for allowing easy insertion thereinto of various interface means, as in the present invention, is not described.

A Patent to Sixsmith, U.S. Pat. No. 4,599,825 describes an interior storm window which secures a flexible plastic material with an inverted "U" shape therein, via end portions which extend into a pair of openings in an extruded rigid plastic material frame which surrounds a pair of glazing sheets. Again, a groove circumferentially present around the outer surface of a sash for allowing easy insertion thereinto of various functionally effective interface means is not described.

Other Patent of which the Inventor is aware, but which are not considered to be particularly relevant are: U.S. Pat. No, 4,510,715 to Giguere; U.S. Pat. No. 5,194,309 to Knudsen; U.S. Pat. No. 2,707,810 to Bolte; U.S. Pat. No. 4,118,266 to Kerr; U.S. Pat. No. 5,184,423 to McCarty; and U.S. Pat. No. 2,029,541 to Martinson.

There remains need for an improved window sash system which can be slideable, or otherwise, mounted in various window frames utilizing various interface means, said various interface means being easy to affix to circumscribing groove means present in an outer essentially planar surface of a window sash. Said improved window sash system should allow affixing different interface means at different location around a window sash circumference to simultaneously effect optimum mechanical and thermal interface results.

DISCLOSURE OF THE INVENTION

The present invention is a window sash frame system comprising at least one window pane retained within a circumscribing sash frame. The circumscribing sash frame presents with typically essentially planar inner and outer surfaces, and, in cross-section, is typically essentially rectangular shaped comprising a width dimension essentially parallel to said essentially planar inner and outer surfaces, and a depth dimension in a direction essentially perpendicular to planes of said essentially planar inner and outer surfaces at any location on said circumscribing sash frame. Most importantly, said circumscribing sash frame has a circumscribing groove projecting thereinto from said typically essentially planar outer surface in the direction of the typically essentially planar inner surface at any location on said circumscribing sash frame, and said circumscribing groove means is of a tapering "V" shape in cross section in the immediate region adjacent to said typically essentially planar outer surface at any location on said circumscribing sash frame. Said circumscribing groove means becomes of a functional cross-sectional shape which can be essentially straight parallel walled, essentially straight parallel walled with depressions, essentially straight tapering walled, and essentially sawtooth shape walled, beyond said region immediately adjacent to said typically essentially planar outer surface.

While not a requirement of the present invention window sash it will typically contain two window panes present centrally within said circumscribing sash frame, said two window panes being secured in said circumscribing sash frame in grooves which project from said typically essentially planar inner surface outwardly toward said typically essentially planar outer surface at any location on said circumscribing sash frame. In such an embodiment, a plane of the circumscribing groove means will typically project essentially perpendicularly from said typically essentially planar outer surface toward said typically essentially planar inner surface at any location on said circumscribing sash frame, between the planes of said two window panes.

The present invention window sash frame system further comprises at least one interface means, with said at least one interface means being mated to said circumscribing sash frame over at least a portion thereof, by insertion of a rigid insertional lip of said interface means into said circumscribing groove means over a portion of said circumscribing groove means. In use an interface means serves to effect functional interface to a window frame or another window sash frame system interface system.

A very important aspect of the present invention window sash system, is the circumscribing groove means is of a tapering "V" shape in cross section in the immediate region adjacent to said typically essentially planar outer surface at any location on said circumscribing sash frame. Said shape allows an interface means to comprise a guide means presenting with a matching "V" cross-sectional shape, which guide means slideably mates, in use, with said "V" shaped groove means in said circumscribing sash frame in the region adjacent to said typically essentially planar outer surface thereof. That is, the matching "V" shape guide means becomes the rigid insertional lip, such that said interface means can be affixed to a lower window frame and said window sash frame system can be caused to slideably move thereupon.

It is also to be understood that at times a lining of a different material present on the tapering "V" shaped groove means facilitates the ability to slide a window sash frame system over a matching "V" shape guide means. The present provides for such with an interface means which comprises in sequence, an rigid insertional lip which functionally mates with said groove means beyond the tapering "V" shape region thereof, and provides a groove means comprising a tapering "V" shape in cross-section which is made of a different material than said window sash system. In use said interface means groove means, is again caused to slideably mate with a matching "V" cross-sectional shape guide means which is present in a lower window frame, such that said window sash frame system can be caused to slideably move thereupon.

The present invention provides additional interface means. For instance, an interface means can comprise a guide means presenting with an elongated tapering cross-sectional shape, which guide means slideably contacts, in use, inner walls of said groove means beyond the cross-sectional "V" shape thereof, said elongated tapering cross-sectional shape guide means being said rigid insertional lip, such that said interface means can be affixed to a window frame and said groove means of said window sash frame system can be caused to removably contain said rigid insertional lip, thereby effecting an insulating interconnection therebetween.

Another interface means can comprise, in sequence, said rigid insertional lip, a hinge means, and a projecting element, such that in use said projecting element can be affixed to a window frame, to the end that said window sash frame system is pivotally affixed to said window frame.

Another interface means can comprise, in sequence, said rigid insertional lip, and an element perpendicularly oriented with respect thereto, said perpendicularly oriented element having ends extending beyond the width dimension of said window sash frame system on both sides of an interconnection point between said rigid insertional lip and said perpendicularly oriented element. In this case said perpendicularly oriented element can have seal mounting means present on one end thereof, or on both ends thereof, which extend beyond the width dimension of said window sash frame system. In use, a seal means mounted in said seal mounting means can interact with a similar seal means mounted in a similar seal mounting means present on a second window sash frame system, or with a seal means present in a window frame and thereby effect a weather-tight interconnection between said window sash frame systems.

Another interface means can comprise, in sequence, said rigid insertional lip and two arcuate shaped projecting elements affixed thereto, each of said arcuate shaped elements projecting generally perpendicularly beyond the width dimension of said sash frame, but opposite sides of said rigid insertional lip.

Another interface means can comprise, in sequence, said rigid insertional lip, and a fork shaped element comprising two separated projections, such that in use said two separated projections can be caused to sandwich a fin projected from a window frame, and thereby effect a weather tight seal therewith.

Another interface means can comprise, in sequence, said rigid insertional lip interconnected to a second oppositely directed rigid insertional lip, such that in use said interface means can be caused to join two window sash frame systems. In this case which said interface means can further comprise a perpendicularly oriented element having ends extending beyond the width dimension of said window sash frame system on both sides of the interconnection point between said oppositely directed rigid insertional lips, said perpendicularly oriented element having a cap element affixed at one end thereof such that it contacts an outer surface of said window sash frame system.

An important specific embodiment of the present invention window sash frame system comprises four sides and is essentially rectangular as viewed in frontal elevation. The outer essentially planar surfaces of said four sides being caused, in use, to face, respectively, downward, to the left, upward, and to the right. The circumscribing groove means located in the essentially planar surface of the side of said window sash frame caused to face downward, in use, is caused to have therein an interface means consisting of guide means presenting with a matching "V" cross-sectional shape, which guide means slideably mates, in use, with said "V" shaped groove means in said circumscribing sash frame in the region adjacent to said outer surface thereof. In this embodiment the matching "V" shape guide means is the rigid insertional lip and said interface means is affixed to a lower window frame and said window sash frame system can be caused to slideably move thereupon. In this important specific embodiment the essentially circumscribing groove present in at least one of the remaining three sides of the essentially rectangular shaped window sash, the essentially planar surfaces of which are caused to face, respectively, to the left, upward, and to the right, has an interface means present therein selected from the group consisting of:

a. a guide means presenting with an elongated tapering cross-sectional shape, which guide means slideably contacts, in use, inner walls of said groove means beyond the cross-sectional "V" shape thereof, said elongated tapering cross-sectional shape guide means being said rigid insertional lip, such that said interface means can be affixed to a window frame and said groove means of said window sash frame system can be caused to removably contain said rigid insertional lip, thereby effecting an insulating interconnection therebetween;

b. in sequence, said rigid insertional lip, and an element perpendicularly oriented with respect thereto, said perpendicularly oriented element having ends extending beyond the width dimension of said window sash frame system on both sides of an interconnection point between said rigid insertional lip and said perpendicularly oriented element;

c. in sequence, said rigid insertional lip, and an element perpendicularly oriented with respect thereto, said perpendicularly oriented element having ends extending beyond the width dimension of said window sash frame system on both sides of the interconnection point between said rigid insertional lip and said perpendicularly oriented element perpendicularly oriented element has seal mounting means present on one end thereof which extends beyond the width dimension of said window sash frame system, such that, in use, a seal means mounted in said seal mounting means can interact with a similar seal means mounted in a similar seal mounting means present on a second window sash system, and thereby effect a weather-tight interconnection between said window sash frame systems;

d. in sequence, said rigid insertional lip, and an element perpendicularly oriented with respect thereto, said perpendicularly oriented element having ends extending beyond the width dimension of said window sash frame system on both sides of the interconnection point between said rigid insertional lip and said perpendicularly oriented element in which said perpendicularly oriented element has weather seal mounting means present on both ends thereof which extend beyond the width dimension of said window sash frame system, such that in use said interface means can be positioned in a window frame and effect a weather-tight seal therewith;

e. in sequence, said rigid insertional lip and two arcuate shaped projecting elements affixed thereto, each of said arcuate shaped elements projecting generally perpendicularly beyond the width dimension of said circumscribing sash frame, but opposite sides of said rigid insertional lip;

f. in sequence, said rigid insertional lip, and a fork shaped element comprising two separated projections, such that in use said two separated projections can be caused to sandwich a fin projected from a window frame, and thereby effect a weather tight seal therewith;

g. in sequence, said rigid insertional lip interconnected to a second oppositely directed rigid insertional lip, such that in use said interface means can be caused to join two window sash systems;

h. in sequence, said rigid insertional lip interconnected to a second oppositely directed rigid insertional lip, such that in use said interface means can be caused to join two window sash systems, said interface means further comprising a perpendicularly oriented element having ends extending beyond the width dimension of said window sash frame system on both sides of the interconnection point between said oppositely directed rigid insertional lips, said perpendicularly oriented element having a cap element affixed at one end thereof such that it contacts an outer surface of said window sash frame system.

As described earlier, at times it is beneficial to provide a tapering "V" shape groove means, in cross-section, which is made of a different material than said window sash frame system, and where that is the case an interface means can comprise, in sequence, a rigid insertional lip which functionally mates with said groove means beyond the tapering "V" shape region thereof, and provides a groove means comprising a tapering "V" shape in cross-section which is made of a different material than said window sash frame system. In use said interface means groove means, is again caused to slideably mate with a matching "V" cross-sectional shape guide means which is present in a lower window frame, such that said window sash frame system can be caused to slideably move thereupon.

Another important embodiment of the present invention window sash frame system also comprises four sides and is essentially rectangular as viewed in frontal elevation, in which the outer essentially planar surfaces of said four sides are caused to face, respectively, downward, to the left, upward, and to the right. In this embodiment, the circumscribing groove means located in one of the essentially outer planar surfaces of the window sash frame system caused to face in a direction selected from the group downward, to the left, upward and to the right, has present therein, in sequence, said rigid insertional lip, a hinge means, and a projecting element, such that in use said projecting element is affixed to a window frame, to the end that said window sash frame system is pivotally affixed to said window frame.

While not a requirement of the present invention, the present invention window sash frame system can be utilized with a related window frame system which is the subject of co-pending Application Ser. No. 08/610,483. It is noted that the window frame system disclosed in co-pending Application Ser. No. 08/610,483 was developed with the present window sash frame system in mind and said window frame system is comprised of inner and outer window frames, each of which inner and outer window frames is of a single piece construction. There are two primary embodiments of the inside (outside) window frame, one which is similar to the outside (inside) window frame in that it includes window sash system guide means for slideably containing window sash systems, and one which does not provide window sash system guide means for slideably containing window sash systems. Typically inner and outer window sash systems, which both include window sash system guide means for slideably containing window sash systems, will be applied to buildings and houses or the like, the walls of which are formed from two (2) by six (6) materials, (i.e. which are six (6) inches deep). The end result is a highly insulating double window sash system. However, in walls of buildings or houses or the like which are constructed from two (2) by four (4) materials, (e.g. the wall is approximately four (4) inches deep), typically only one the described window frames will provide window sash system guide means for slideably containing window sash systems. This is because there is not sufficient wall depth room present to include two present window frames which each provide window sash system guide means for slideably containing window sash systems. In a modified embodiment, however, both present inner and outer window frames applied to a wall constructed from two (2) by four (4) inch materials can provide means for slideably containing window sash systems. In said modified embodiment a portion of at least one, (i.e. a present inner or outer window frame), will extend beyond the surface plane of an inner or outer building or house or the like wall.

It is to be appreciated that the described inner and outer window frames allow a user to install an outer window frame, and then while still accessible, (i.e. prior to installing a mating inside window frame), apply foam insulation therearound. This is not possible in combined inner and outer single piece window frame systems. Also, both inside and outside present window frames include elements for effecting slideable mating between facing analogically similar points of said inner and outer window frames which make simultaneous contact with one another when mounted in a building or house or the like. Said slideable mating taking place at a central location within said wall. By using separate inner and outer window frames, it is possible to position each with respect to the another so that projecting trim, which is present on each is of the inner and outer present window frames, is simultaneously flush with the wall, (i.e. inside or outside respectively), to which it is mounted. A prefabricated single piece window frame can not provide this adjustment in the field. As well, as the present inner and outer window frames are each made independently, by a resin transfer molding process, the molding for each is simpler than for a single combined inner and outer single piece window frame system. Benefits enabled by a two piece present window frame system are then:

a. provision of the ability to apply insulating foam around a first installed present window frame while access thereto is still available (e.g. prior to installation of the other present window frame);

b. provision of the ability to slideably adjust the distance between installed present inner and outer window frames, (to compensate for specific wall depth present), so that trim on each is flush against inner and outer wall surfaces respectively, when installation is complete; and c. ease in fabrication.

As mentioned the described inner and outer window frames are of each of a single piece construction, which, as viewed in frontal elevation comprise vertically oriented Right and Left Jambs, a generally horizontally oriented Bottom Sill and a horizontally oriented Top Head. The generally horizontally oriented window frame Bottom Sill has a first and a second lower window sash system guide means extending essentially the horizontally oriented length of an upward facing surface of said generally horizontally oriented Bottom Sill, and the horizontally oriented Top Head has a first and a second upper window sash system guide means extending essentially the horizontally oriented length of a downward facing surface of said horizontally oriented Top Head. Said first and second upper window sash system guide means extend upward into said downward facing surface of said horizontally oriented Top Head to first and second depths, with a change in said depth occurring approximately half way along the horizontally oriented length of said Top Head. The first upper window sash system guide being shallower than the second one on one horizontally oriented side, and with said second upper window sash system guide means being shallower than said first upper window sash system guide means on the other horizontally oriented side. In use a window sash system can be caused to be horizontally slideably retained within Bottom Sill and Top Read corresponding first window sash system guide means and simultaneously a second window sash system can be caused to be horizontally slideably retained within Bottom Sill and Top Head corresponding Second window sash system guide means. When said window frame is affixed to a building wall and window sash systems are present within each corresponding horizontally oriented first and second lower and upper window sash system guide means respectively, each of said window sash systems can be placed in a closed window sash system position wherein each said window sash system is positioned below the shallower Top Head contained upper window sash system guide means such that said window sash systems can not be pried upward. As well, each window sash system can slide horizontally so as to be placed in an open position beneath the deeper upper Top Head contained window sash system guide means. Said window frame also comprises mating elements located thereon such that when said window frame is installed on a side of said wall selected from the group consisting of inner and outer side of a wall of a building, mating elements on facing analogically similar points of another window frame of similar size and shape mounted on a side of said wall selected from the group consisting of outer and inner respectively, can make slideable contact with said mating elements.

The window frame vertically oriented Jamb adjacent to a shallower Top Head contained upper window sash system guide means typically has therein a window sash system edge receiving means, such than when a window sash system present in said window frame is placed in a closed window sash system position, an edge thereof adjacent to said window sash system edge receiving means is caused to be present therein. This occurs simultaneous with an upper edge of said window sash system being present within said shallower of the Top Head contained upper window sash system guide means and with a lower edge of said window sash system being present within said Bottom Sill contained lower window sash system guide means. It is noted that to effect a smooth uncluttered appearance in present window frames, similar window sash system receiving means are not present in said window frame adjacent to deeper Top Head contained window sash system contained upper window sash system guide means.

For the purposes of effecting improved insulation capability, a ridge which projects from a centrally facing surface in said window sash system edge receiving means can be provided, said ridge being comprised of a material which provides insulating contact between said window sash system edge receiving means and a window sash system contained edge.

It is noted that in a described window frame of single piece construction the shallower upper window sash system guide means can be located on the right or left side thereof, as said window frame is viewed in frontal elevation when said inner and outer window frames are mounted in a wall of said building.

Further, it is to be appreciated that the first and second lower window sash system guide means are preferably arrow-head shaped and lower edges window sash systems placed into said first and second window sash system guide means have a matching "V" shape which slideably mates therewith in use. Said arrow head shape can be effected by an aluminum insert, or be effected as an integral part of the window frame.

While not a limitation, the first and second upper window sash system guide means can be arcuate shaped as viewed in side cross-sectional elevation, such that when a window sash system with an arcuate shaped upper edge placed thereinto, is caused to be positioned beneath a deeper upper window sash system guide means, said window sash system can be lifted upward into said deeper window sash system guide means so that a lower edge of said window sash system is caused to be removed from a corresponding lower window sash system guide means. When said window sash system, so positioned, is then caused to be rotated about a longitudinal axis defined by the horizontally upper edge of said window sash system present within said deeper upper window sash system guide means, removal of said window sash system from said window frame can be achieved. A similar rotation mediated sash removal procedure will, of course, work where said sash is of an essentially planar shape.

A presently described window frame of single piece construction, can further comprise trim extending therefrom such that when said window frame is mounted to a building wall and viewed in frontal elevation, said trim extends over a portion of a wall in directions surrounding said inner window frame selected from the group consisting of right and left horizontal and up and down vertical.

As well, a present window frame can further comprise locking means for securing window sash systems in a closed window sash system position.

An important aspect of the described window frames is that said generally horizontally oriented Bottom Sill can present with a downward slope as viewed in side elevation, such that when said window frame is mounted to an outside wall of a building or house or the like, rain water falling thereonto will run off thereof away from said wall. In addition, a present Window Frame can present with both horizontal and downward sloping portions.

It is also to be appreciated that a described window frame can further comprise screen receiving means for containing a screen therein in use.

As alluded to infra, it is to be understood that a present window frame of a single piece construction need not be fitted with window sash guide means. Hence a window frame can, as viewed in frontal elevation comprise vertically oriented Right and Left Jambs, a generally horizontally oriented Bottom Sill and a horizontally oriented Top Head, in combination with trim extending therefrom such that when said window frame is mounted to a building wall and viewed in frontal elevation, said trim extends over a portion of a wall in directions surrounding said inner window frame selected from the group consisting of right and left horizontal and up and down vertical. Such a window frame will also comprise mating elements located thereon such that when said window frame is installed on a side of said wall selected from the group consisting of inner and outer side of a wall of a building, mating elements on facing analogically similar points of another window frame of similar size and shape mounted on a side of said wall selected from the group consisting of outer and inner respectively, can make slideable contact with said mating elements. Said embodiment can also comprise screen receiving means.

With the basic structures of preferred individual window frames now described, it is specifically noted that a window frame system for containing window sash systems will typically comprise two such single piece window frames, termed inner and outer window frames. In use said outer window frame is mounted to a building wall with window sash systems mounted therein, if present, positioned so as to contact at least an environment outside the building, and such that window sash systems mounted within said inner window frame, if present, are positioned so as to contact at least an environment inside said building. (Note that a window frame need not contain window sash systems as described infra, hence window sash systems need not be present in both inner and outer window frames, and in such a case a window pane could contact both inner and outer environments). Continuing, said present invention inner and outer window frames are of similar sizes and shapes, so that when installed in a wall of a building, mating elements on facing analogically similar points of said inner and outer window frames can make simultaneous slideable contact with one another.

It is noted that described window frames are preferably formed by resin transfer molding. It is to be noted that resin transfer molding comprises an injection process in which a resin which is compounded to be free flowing is forced into a die under low pressure. The hardening of said resin is catalized by heat, rather than by chemicals. As applied in the present invention, said resin transfer molding allows for strength enhancing focused curing of the corners of a present invention window frame. Molds for injecting separate inner and outer present invention window frames, it is noted, are much simpler than molds required for one-piece window frames wherein the inner and outer window frames constitute a single piece.

The preceding recitation of the structure of the window frames which are the subject of co-pending Application Ser. No. 08/610,483 should help make clear the importance of said circumscribing groove means in the present invention window sash frame system, which circumscribing groove means is of a tapering "V" shape in cross section in the immediate region adjacent to said essentially planar outer surface at any location on said circumscribing sash frame system, followed by a functional cross-sectional shape which can be essentially straight parallel walled, essentially straight parallel walled with depressions, essentially straight tapering walled, and essentially sawtooth shape walled, beyond said region immediately adjacent to said essentially planar outer surface. It must be understood, however, that the present invention window sash frame system, when conveniently, variously combined with described present invention interface means, can be used with essentially any window frame system.

It is noted that the insertion of a rigid insertional lip of an interface means into said circumscribing groove means of a window sash, is, if a slidable interface is not desired, typically secured in place by use of an adhesive, preferably silicone.

The present invention will be better understood by reference to the Detailed Description Section of this Disclosure, in conjunction with the accompanying Drawings.

DETAILED DESCRIPTION

Figure 1:
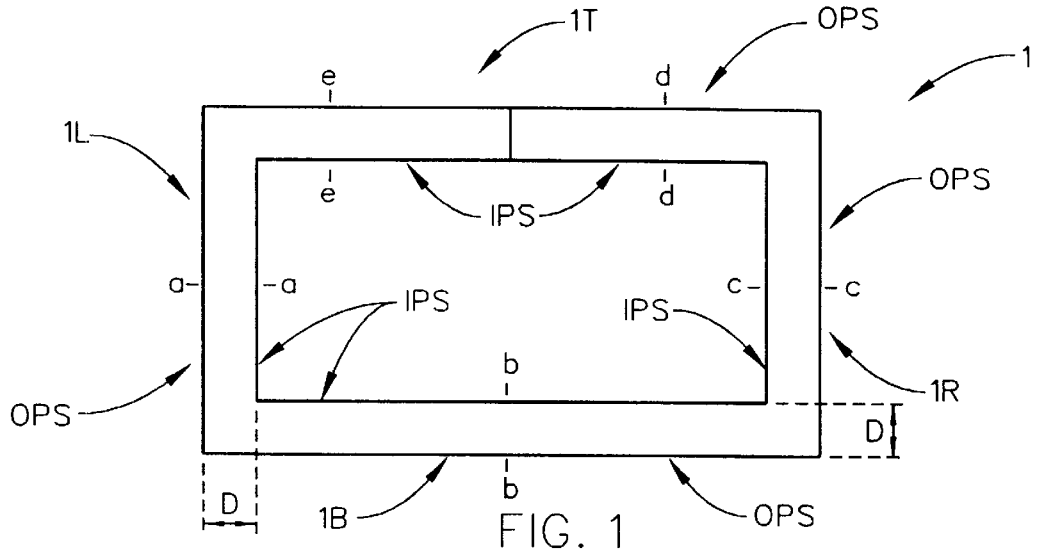
FIG. 1 demonstrates a present invention window sash frame system, of single piece construction, in frontal elevation.

Turning now to the Drawings, there is shown in FIG. 1 a general front elevational view of a present invention window sash system which comprises at least one window pane (WP) retained within a circumscribing sash frame (1). As best appreciated by viewing FIG. 2, the circumscribing sash frame (1) presents with essentially planar inner (IPS) and planar outer (OPS) surfaces, and, in cross-section, is essentially rectangular shaped comprising a width dimension (W) parallel to said essentially planar inner (IPS) and planar outer (OPS) surfaces, and a depth dimension (D) in a direction perpendicular to planes of said essentially planar inner and outer surfaces at any location on said circumscribing sash frame. Note that FIG. 1 shows cross-sectional points a—a, b—b, c—c, d—d and e—e. FIGS. 3*a,* 3*b,* 3*c* and 3*d* show cross-sectional views which are valid at any of said a—a, b—b, c—c, d—d and e—e points of cross-section for various modifications of present invention which are configured to contain two (2) window panes. Note that FIGS. 2, 3*a,* 3*b,* 3*c* and 3*d* all show that said circumscribing sash frame (1) has a circumscribing groove means (IG1), (IG2), (IG3) and (IG4) respectively, projecting thereinto from said essentially planar outer (OPS) surface in the direction of the essentially planar inner (IPS) surface at any location on said circumscribing sash frame (1). Note in particular that all circumscribing groove means are of a tapering "V" shape (1BV) in cross section in the immediate region adjacent to said essentially planar outer (OPS) surface at any location on said circumscribing sash frame (1). Said circumscribing groove means becomes of a functional cross-sectional shape which can be essentially straight parallel walled, (see FIG. 3*a* (IG1)), essentially straight parallel walled with depressions, (see FIG. 3*c,* (IG3)), essentially straight tapering walled, (see FIG. 3*d* (IG4)), and essentially sawtooth shape walled, (see FIG. 3*b* (IG2)), beyond said tapering "V" shaped region (1BV) immediately adjacent to said essentially planar outer (OPS) surface.

It is emphasized that the Figures show a window sash frame (1) which is configured to hold two (2) window panes (WP). This is not a requirement of the present invention window sash, but is a preferred embodiment. That is, a present invention window sash frame (1) will typically include two (2) two window pane containing grooves (WS1) and (WS2) in said circumscribing sash frame (1), with two (2) window panes (WP's) being secured in said circumscribing sash frame (1) in said window pane containing grooves (WS1) and (WS2) which project from said essentially planar inner (IPS) surface outwardly toward said essentially planar outer (OPS) surface at any location on said circumscribing sash frame (1). In such an embodiment, a plane of the circumscribing groove means (IG1), (IG2), (IG3) or (IG4) will typically project perpendicularly from said essentially planar outer (OPS) surface toward said essentially planar inner (IPS) surface at any location on said circumscribing sash frame (1), between the planes of said two window panes (WP's).

The present invention window sash frame system further comprises at least one interface means (IM), with said at least one interface means being mated to said circumscribing sash frame (1) over at least a portion thereof, by insertion of a rigid insertional lip (IL) of said interface means into said circumscribing groove means over a portion of said circumscribing groove means. In use an interface means (IM) serves to effect functional interface to a window frame (WF) or another window sash frame system interface system (IM). FIGS. 4–16 show various modular interface means (IM).

Figure 4:
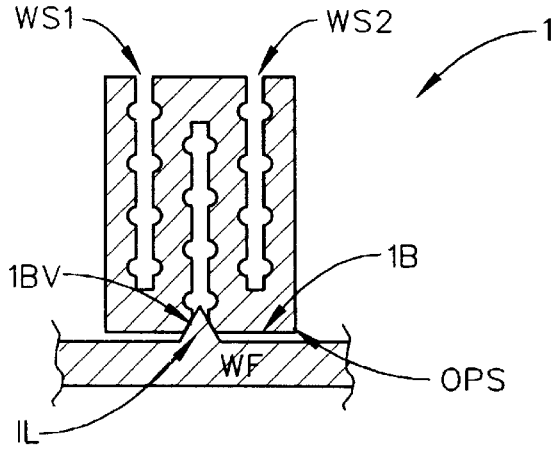
FIG. 4 shows a present invention window sash frame system in combination with a preferred window frame system, demonstrating slideably interaction between said circumscribing groove and an interface means insertional lip.

A very important aspect of the present invention window sash system, is the circumscribing groove means is of a tapering "V" shape (1BV) in cross section in the immediate region adjacent to said essentially planar outer (OPS) surface at any location on said circumscribing sash frame. Referral to FIG. 4 shows that said shape allows an interface means (IM) to comprise a guide means (IL) presenting with a matching "V" cross-sectional shape, which guide means (IL) slideably mates, in use, with said "V" shaped groove means (IBV) in said circumscribing sash frame (1) in the region adjacent to said outer surface (OPS) thereof. That is, the matching "V" shape guide means (IL) becomes the rigid insertional lip (IL), such that said interface means (IM) can be affixed to a lower window frame (WF) and said circumscribing window sash frame system (1) can be caused to slideably move thereupon.

Figure 11:
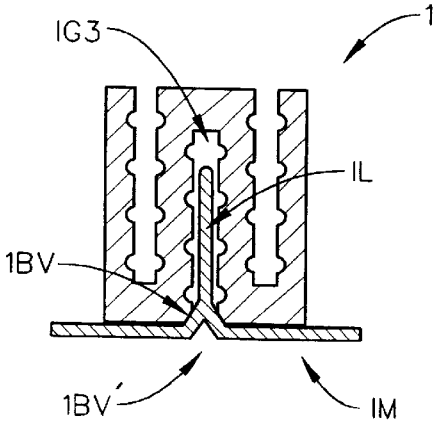
Figure 12:
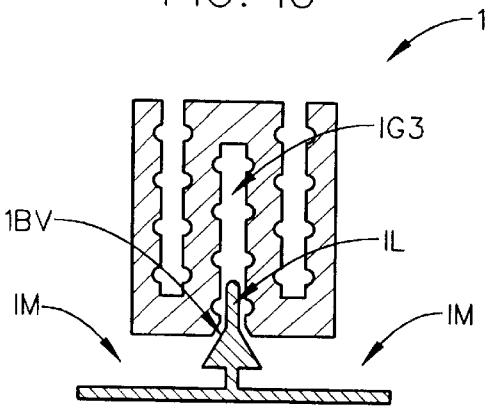

It is also to be understood that at times a lining of a different material present on the tapering "V" shaped groove means facilitates the ability to slide a window sash frame system over a matching "V" shape guide means. FIG. 11 shows that the present provides for such with an interface means (IM) which comprises in sequence, a rigid insertional lip (IL) which functionally mates with said groove means (shown as a FIG. 3 (IG3)), beyond the tapering "V" shape region (1BV) thereof, and provides a groove means (1BV') comprising a tapering "V" shape in cross-section which is made of a different material than said window sash frame system. In use said interface means groove means, is again caused to slideably mate with a matching "V" cross-sectional shape guide means which is present in a lower window frame, such that said window sash frame system can be caused to slideably move thereupon. The reason for the FIG. 11 demonstrated interface means (IM) is that it has been found that a metal tapering "V" shape, in cross-section, groove means for instance, slides better over a cured resin matching "V" cross-sectional shape guide means, than does a tapering "V" shape, in cross-section, groove means also made of cured resin, and window frames can be made of cured resin as well as described in Co-pending Application Ser. No. 08/610,483.

Figure 5:
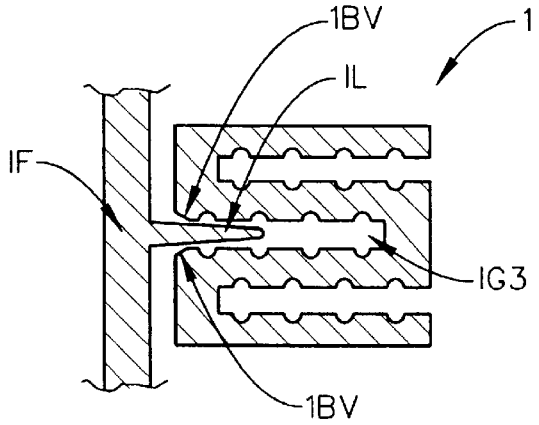
FIGS. 5–16 demonstrate various variations of present invention interface means and show that all are comprised of an insertional lip which is interfaced with a circumscribing groove in an outer surface of a present invention window sash frame system. The variations in geometry into which said insertional lip merges are fashioned to allow interface to various window frames and to allow functional interaction with other interface means.

The present invention provides additional interface means (IM). For instance, FIG. 5 shows that an interface means (IM) can comprise a guide means (IL) presenting with an elongated tapering cross-sectional shape, which guide means (IL) slideably contacts, in use, inner walls of said groove means, (shows as a FIG. 3*c* (IG3)), beyond the cross-sectional "V" shape (1BV) thereof, said elongated tapering cross-sectional shape guide means (IL) being said rigid insertional lip (IL), such that said interface means (IM) can be affixed to a window frame and said groove means of said window sash frame system can be caused to removably contain said rigid insertional lip (IL), thereby effecting an insulating interconnection therebetween.

Figure 7:
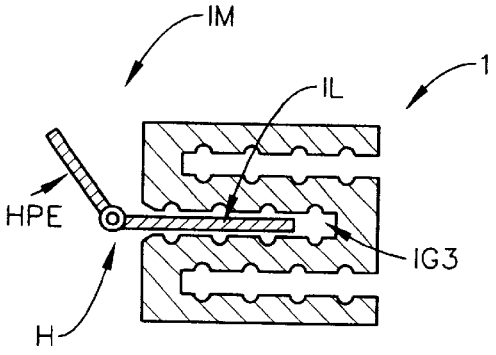

FIG. 7 shows that another interface means (IM) can comprise, in sequence, said rigid insertional lip IL), a hinge means (H), and a hinge projecting element (HPE), such that in use said hinge projecting element (HPE) can be affixed to a window frame, to the end that said window sash frame system is pivotally affixed to said window frame.

Figure 8:
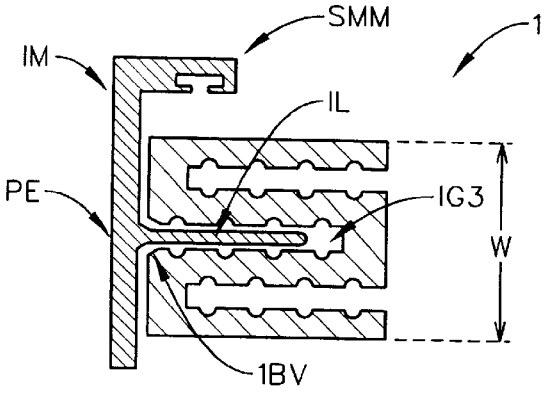
Figure 9:
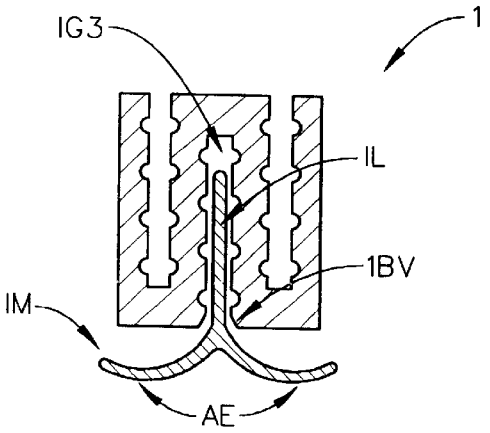
Figure 10:
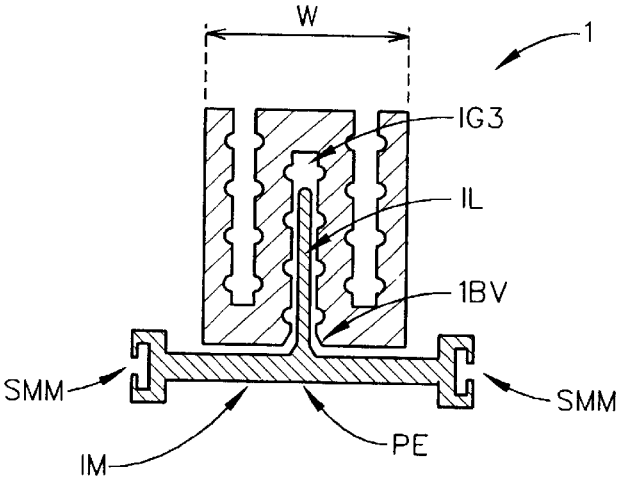
Figure 13:
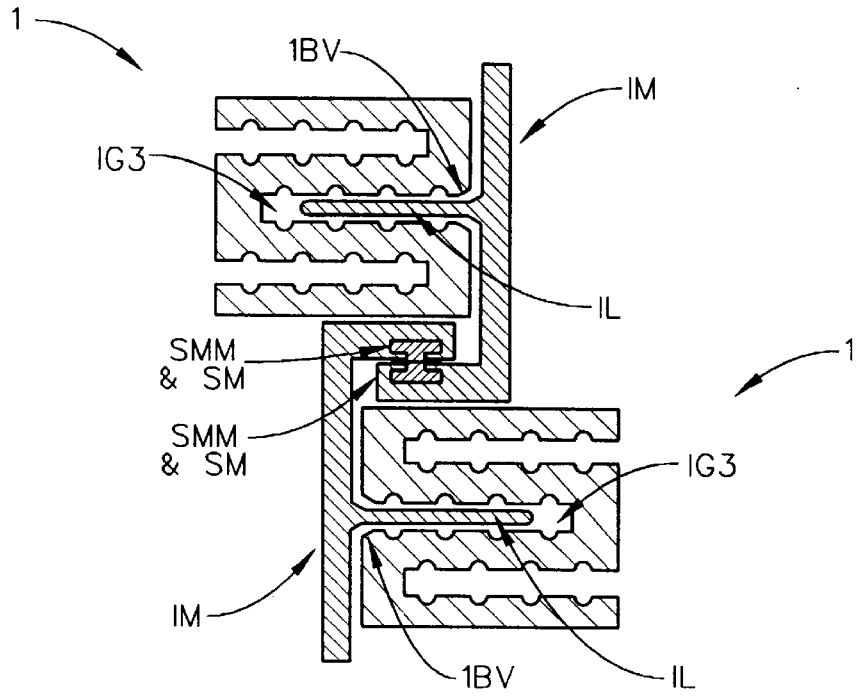

FIGS. 8 and 10 show that other interface means can comprise, in sequence, said rigid insertional lip (IL), and an element (PE) perpendicularly oriented with respect thereto, said perpendicularly oriented element (PE) having ends extending beyond the width dimension (W) of said window sash frame system (1) on both sides of an interconnection point between said rigid insertional lip (IL) and said perpendicularly oriented element (PE). In this case said perpendicularly oriented element (PE) can have seal mounting means (SMM) present on one end thereof, or on both ends thereof, which extend beyond the width dimension (W) of said window sash frame system (1). In use, a seal means ((SM), see FIGS. 13 and 15)), mounted in said seal mounting means (SMM) can interact with a similar seal means (SM) mounted in a similar seal mounting means (SMM) present on a second window sash system, or with a seal means (SM) present in a window frame (WF) and thereby effect a weather-tight interconnection between said window sash frame systems. Note that FIG. 13 shows a top cross-sectional view of two present invention window sash frame systems (1) with FIG. 8 interface means (IM) affixed thereto via insertion of rigid insertional lips (IL's) into circumscribing groove means thereof. In use, the lower present invention window sash frame system (1) in FIG. 13 could be caused to move to the left and the upper present invention window sash frame system (1) in FIG. 13 could be caused to move to the right and the interface of the sealing means (SM's) would be broken. A side view of the lower end of each of the FIG. 13 window sash frame systems (1) in FIG. 13 could be configured as shown in FIG. 4 to allow such a sliding motion of a present groove means (1BV) comprising a tapering "V" shape in cross-section, (which could be mediated by an interface means made of a different material than said window sash frame system as demonstrated in FIG. 11), where said interface means groove means (1BV), is caused to slideably mate with a matching "V" cross-sectional shape guide means (IL) which is present in a lower window frame (WF), such that said window sash frame system (1) can be caused to slideably move thereupon.

Figure 16:
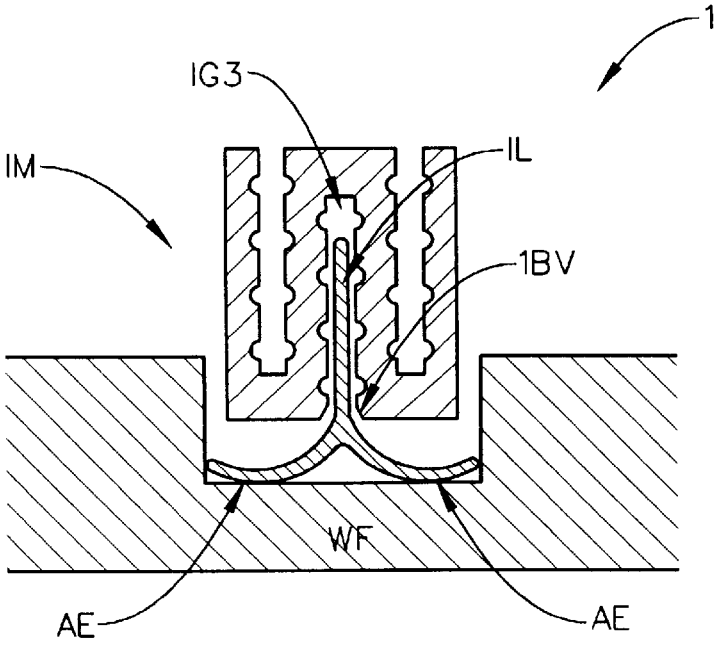

FIG. 16 shows that another interface means (IM) can comprise, in sequence, said rigid insertional lip (IL) and two arcuate shaped projecting elements (AE's) affixed thereto, each of said arcuate shaped elements (AE's) projecting generally perpendicularly beyond the width dimension (W) of said window sash frame (1), but on opposite sides of said rigid insertional lip (IL).

Figure 6:
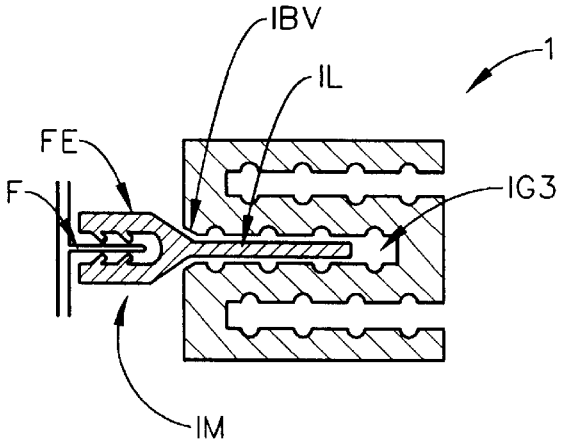

FIG. 6 shows that another interface means (IM) can comprise, in sequence, said rigid insertional lip IL), and a fork shaped element (FE) comprising two separated projections, such that in use said two separated projections can be caused to sandwich a Fin (F) projected from a window frame, and thereby effect a weather tight seal therewith.

Figure 14:
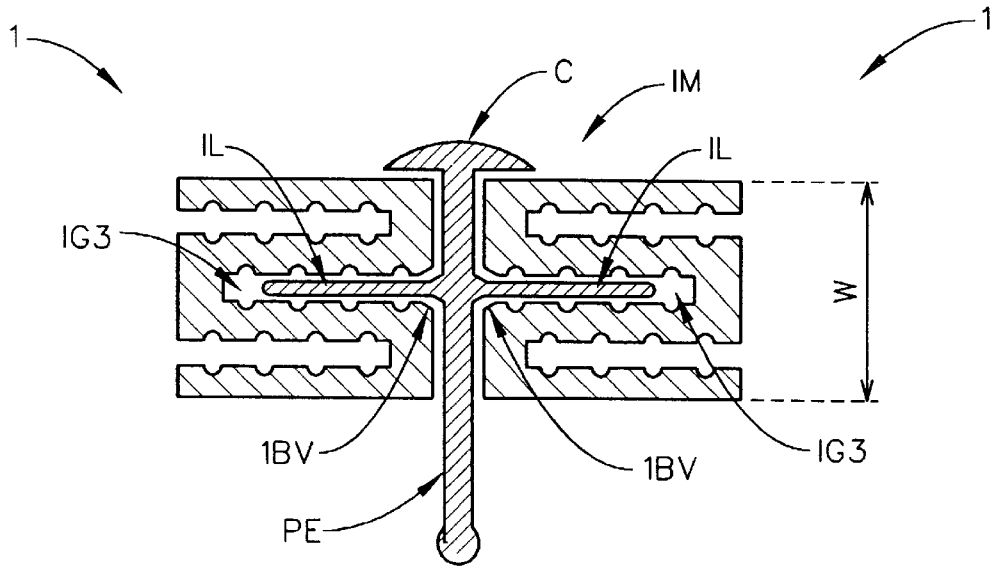
Figure 15:
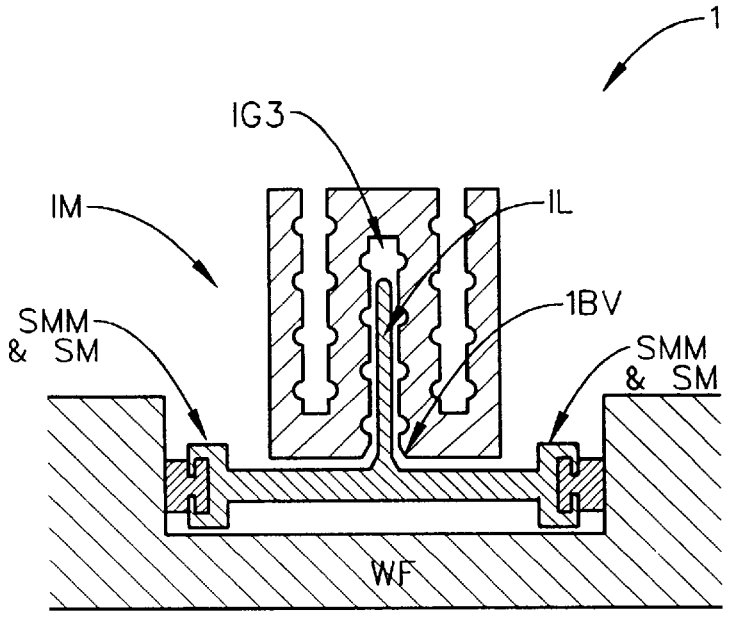

FIG. 14 shows that another interface means (IM) can comprise, in sequence, said rigid insertional lip (IL) interconnected to a second oppositely directed rigid insertional lip (IL), such that in use said interface means can be caused to join two window sash frame systems (1). In this case which said interface means (IM) can further comprise a perpendicularly oriented element (PE) having ends extending beyond the width dimension (W) of said window sash frame system (1) on both sides of the interconnection point between said oppositely directed rigid insertional lips (IL's), said perpendicularly oriented element (PE) having a cap element (C) affixed at one end thereof such that it contacts an outer side surface of said window sash system.

As indicated by FIGS. 1–16, an important specific embodiment of the present invention window sash frame system comprises four sides and is essentially rectangular as viewed in frontal elevation.

It is emphasized that the present invention sash frame system has as a major focal point the shape of the circumscribing groove means (e.g. (IG1), (IG2), (IG3) and (IG4)), projecting thereinto from said essentially planar outer (OPS) surface in the direction of the essentially planar inner (IPS) surface at any location on said circumscribing sash frame (1). Common to all said circumscribing groove means is the tapering "V" shape (1BV) in cross section in the immediate region adjacent to said essentially planar outer (OPS) surface at any location on said circumscribing sash frame (1). Said tapering "V" shape (1BV) allows easy mating directly with guide means in a window frame (WF) as shown in FIG. 4. The remaining portion of the circumscribing groove means beyond said tapering "V" shape (1BV) allows functional securing of various rigid insertional lips (IL) therein as required by specific scenarios, (note adhesive will typically fill the space around an (IL) and within a circumscribing groove means). The many exemplary rigid insertional means (IM's) shown which can be beneficially functionally secured to a present invention window sash frame system (1) show the versatility of the present invention.

The utility of the present invention is found in the ease with which a single window sash extrusion can be customized for specific usage, by functionally securing thereto selected interface means (IM's) at appropriate locations therealong. It is also emphasized that the Insertional lip (IL) is of a rigid construction making it appropriate for use as a structural element in mediating a mechanically operable interface between a present invention window sash frame system circumscribing groove means and, for example, a window frame.

Figure 2:
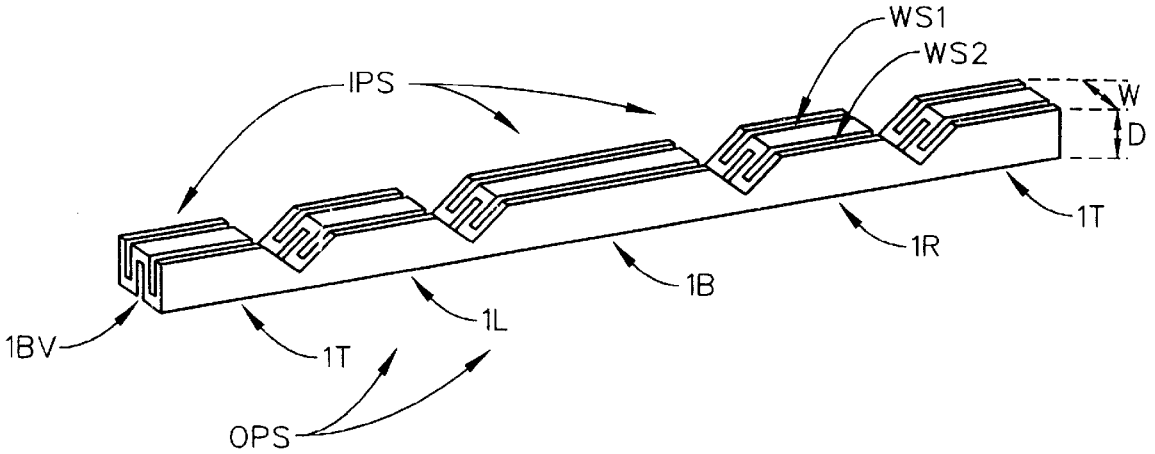
FIG. 2 demonstrates the present invention window sash system of FIG. 1 in perspective, and prior to being formed into a window pane circumscribing sash frame.
Figure 3A:
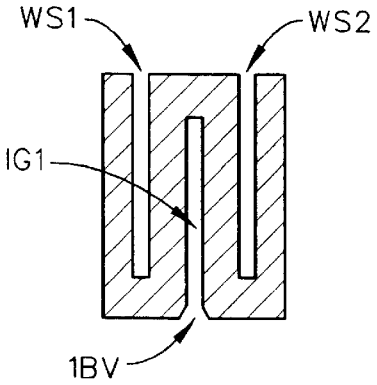
FIGS. 3*a*–3*d* show preferred shapes of a circumscribing groove means present in an outer surface of said present invention window sash system.
Figure 3B:
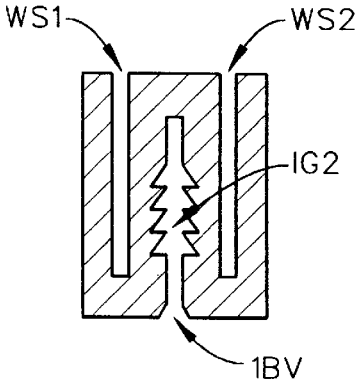
Figure 3C:
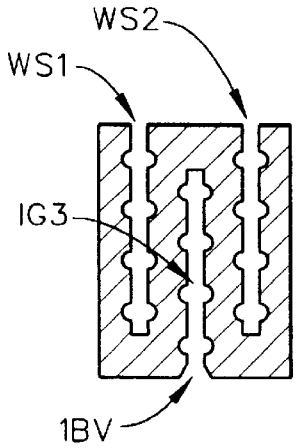
Figure 3D:
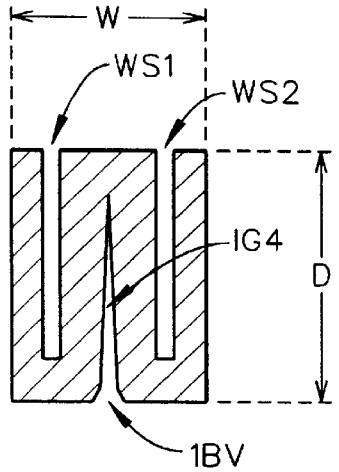

As indicated by FIG. 2 said present invention sash frame system can be easily fabricated by a procedure which provides a linearly oriented extrusion. Said extrusion can then be heated and bent at the various "notches" to cause it to circumvent at least one window pane.

It is noted that the Sash of the present invention has been described as "essentially rectangular" in cross-section. Said terminology is to be interpreted sufficiently broad to include essentially square cross section shapes and configurations wherein one or more sides are rounded. The important point being that a circumscribing groove means (IG1), (IG2), (IG3) and (IG4) project from an outer surface toward an inner surface thereof. As well, the present invention can be applied to Sashes which are other than essentially rectangular in frontal elevation. The Claims should be read in light of the indicted breadth of terminology.

Figure 17:
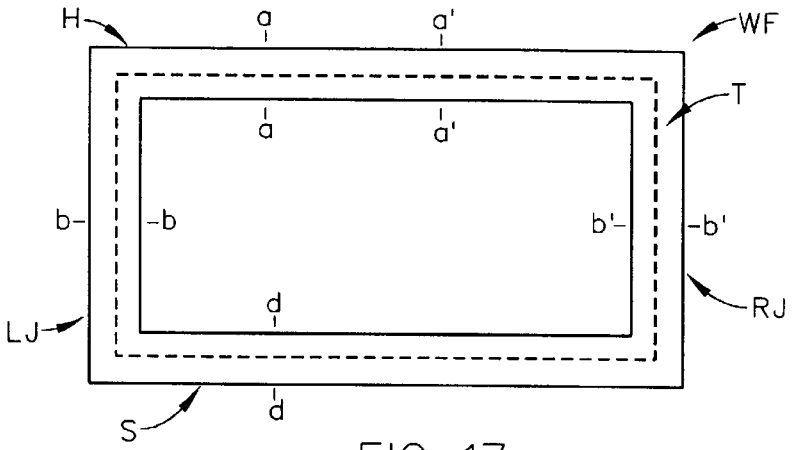
FIG. 17 demonstrates a single piece preferred present invention window frame in frontal elevation.
Figure 19:
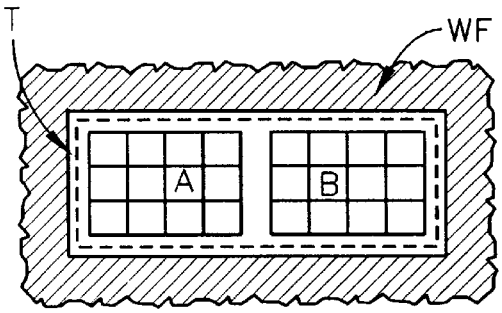
FIG. 19 shows a present invention window frame with left and right positioned window sash systems mounted therein.

Turning now to FIG. 17, there is shown a preferred present invention Window Frame (WF), of single-piece construction, as viewed in frontal elevation. Note that said preferred present invention Window Frame (WF) is typically generally rectangular in shape, with an upper horizontally oriented positioned Head (H), a lower positioned generally horizontally oriented Bottom Sill (S), and a vertically oriented Left Jamb (LJ) and vertically oriented Right Jamb (RJ) present. A dotted line is present in each of the (H), (S), (RJ) and (LJ) to represent the integral presence of trim (T) which in use projects over a wall to which said preferred present invention Window Frame (WF) is mounted in use. FIG. 19 shows a preferred present invention Window Frame with Left (A) and Right (B) positioned Window Sash Systems present therein, and mounted to a Wall (W). In use at least one of said Left (A) and Right (B) positioned Window Sash Systems can be caused to slide easily to an opposite (i.e. Right and Left respectively), side position. In one of said positions said Left (A) and Right (B) positioned Window Sash Systems will be in a "Closed" Position, (see supra), and in the other, in an "Open" Position.

Figure 18A:
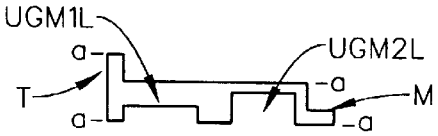
FIGS. 18*a* through 18*j* show cross-sectional views taken at identified locations in FIG. 1, all of which are observed from the right or top of FIG. 1.
Figure 18B:
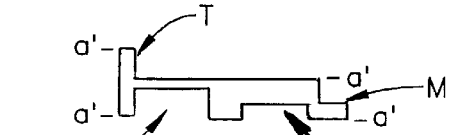
Figure 18C:
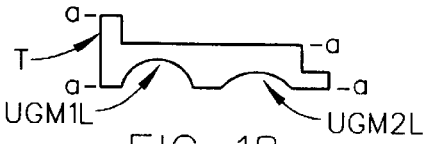
Figure 18D:
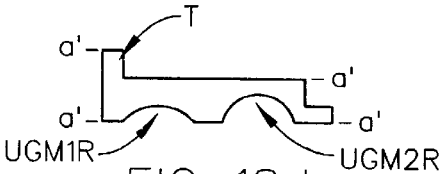

Note that in FIG. 17, designation of location for a number of cross-sectional views is provided. FIGS. 18*a* through 18*j* show said corresponding cross-sectional views, taken from the Right or Top in FIG. 17, at appropriate indicated locations thereon. Note that FIGS. 18*a* and 18*c* are taken in the Head (H) at the left side (—-a) of the preferred present invention Window Frame as viewed in frontal elevation in FIG. 17, and that FIGS. 18*b* and 18*d* are taken in the Head (H) on the right side (a'—a') thereof. FIGS. 18*a* and 18*c* show that on the left side of the preferred present invention Window Frame Head (H), Upper Window Sash System Guide Means (UGM1L) extend deeper into the downward facing surface of the Head (H) than do the shallower Upper Window Sash System Guide Means (UGM2L), but that on the Right side thereof Upper Window Sash System Guide Means (UGM2R) extends deeper into the downward facing surface of the Head (H) than do the shallower Upper Window Sash System Guide Means (UGM1L). FIGS. 18*a* & 18*c* show different embodiments of the shape of said Left Upper Window Sash System Guide Means, and FIGS. 18*b* & 18*d* show different embodiments of the shape of said Right Upper Window Sash System Guide Means. The reasons that an Upper Window Sash System Guide Means extends deeper into a downward facing surface of said Head (H) is that in use, when a Window Sash System is present in a Window Sash Guide Means it is desirable to be able to secure said Window Sash System in a "Closed" position in which said Window Sash System can not be pried upward, but it is also desirable to be able to remove such a present Window Sash System when desired. Thus, when a Window Sash System is caused to be placed beneath a shallower Window Sash System Guide Means, it can be secured in a "Closed" Position, while when placed beneath a deeper Window Sash System Guide Means (an "Open" Position), it can be forced upward and caused to be removed from said preferred present invention Window Frame (WF). The "Arcuate" shapes of said Window Sash System Guide Means shown in FIGS. 18*c* and 18*d* are desirable, but not limiting, and aide with the ease of Window Sash System removal by allowing the upper edge of a Window Sash System to effectively rotate within when urged to do so by a user. (Note that forcing a Window Sash System upward allows it to become free of lower Window Sash System Guide Means positioned in a Window Frame Bottom Sill).

Figure 18E:
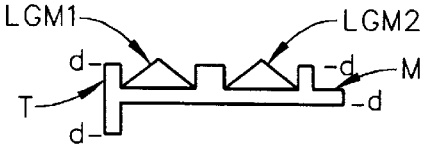
Figure 18F:
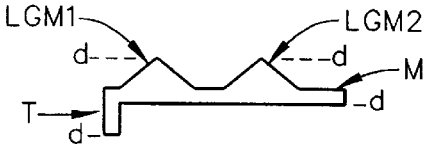
Figure 18G:
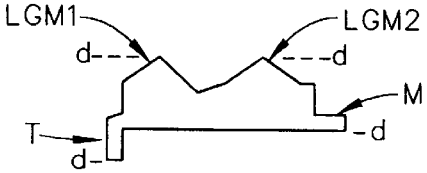
Figure 18G:
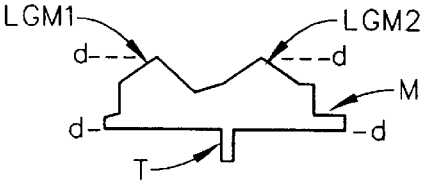

Turning now to FIGS. 18*e* through 18*gb,* there are shown various embodiments of Bottom Sill (S) contained Lower Window Sash System Guide Means (LGM1) and (LGM2). Note that in each case a (LGM1) or (LGM2) has an arrow head shape. In FIG. 18*e* the arrow head shape is formed by an insert which rests in a depression in an upward facing surface of said Sill (S). In this case the insert will typically be made of aluminum. It is found that Window Sash Systems which have a mating inverted "V" shape in their lower edge slide over such an aluminum insert very well in use. FIGS. 18*f,* 18*ga,* and 18*gb* however, show that the arrowhead shapes can be formed as an integral part of the Bottom Sill (S). FIG. 18*e* will typically correspond to a preferred present invention Inner Window Frame, while the profile in FIGS. 18*ga* and 18*gb* will correspond to a preferred present invention Outer Window Frame. The sloped profile in FIGS. 18*ga* and 18*gb* is beneficial to encouraging rain water to run off thereof in use. (Note that FIG. 18*gb* shows Trim (T) positioned so as to meet a Wall of a Building or House or the like with a portion of said represented Wall Frame extending out therebeyond. This allows positioning two Window Sash Systems in such a preferred present invention Window Frame in a Building or House or the like in which a Wall (W) is not sufficiently deep to account for the depth of said preferred present invention Window Frame. It is also to be understood that Trim (T) in Left and Right Jambs and Top Head would be similarly situated. The location of Trim (T) can then vary in the preferred present invention Window Frame as demonstrated without exceeding the scope of the preferred present invention).

Figure 18H:
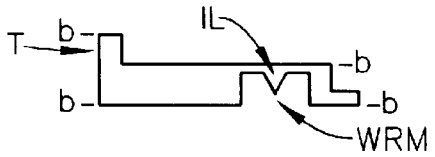
Figure 18I:
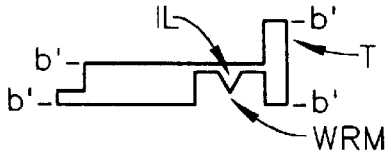

FIGS. 18*h* and 18*i* show that Left (LJ) and Right (RJ) Jambs can have Window Sash System Receiving Means (WRM) therein, positioned so as to be able to receive an edge of a Window Sash System, ("A" or "B") in use, when said Window Sash System is positioned in said preferred present invention Window Frame in a "Closed" Position, (that is, an upper edge of such a Window Sash system is placed under a shallower Upper Window Sash System Guide means such as ((UGM2L) or (UGM2R)). A projecting Ridge (I) can also be in the Window Sash System Receiving Means (WRM) present to act as an Convection Insulator Means. Said projecting Ridge (I) is typically made of a compressible material. Note that similar Window Sash Receiving Means are not present in a Jamb adjacent to a deeper Upper Window Sash System Guide Means. This serve to provide a smoother, uncluttered appearance to a preferred present invention window frame.

Figure 18J:
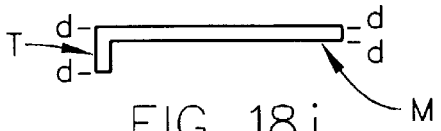

FIG. 18*j* shows an embodiment of a preferred present invention window frame which does not provide means for slideably retaining a window sash system. Typically such a preferred present invention window frame will be utilized as an inner window frame, with an outer window frame which provides means for slideably retaining window sash systems, such as represented by FIGS. 17 through 18*ga.* The FIG. 18*j* embodiment will typically be utilized in the case that a wall is constructed from two (2) by four (4) materials, and there is not sufficient wall "depth" present to allow both inner and outer preferred present invention window frames to contain window sash systems. However, note that the configuration of FIG. 18*gb,* which involves a window frame which extends beyond the plane of a wall to which it is mounted, can be utilized in a wall constructed from two (2) by four (4) materials.

Figure 20:
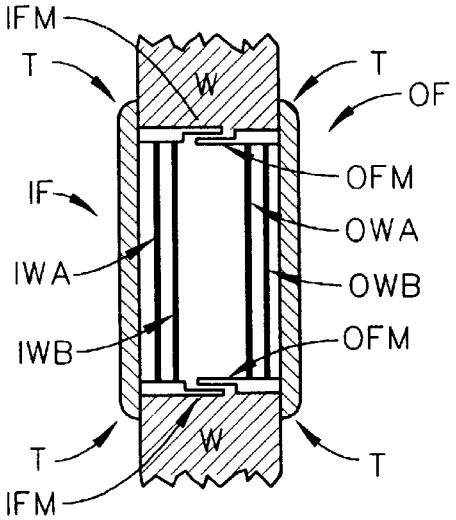
FIG. 20 shows two present invention window frames, (inner and outer), each of single piece construction mounted to the inside, and to the outside respectively of a wall of a building. Facing, analogically similar, portions of said frames being oriented so as to mate with one another.
Figure 21A:
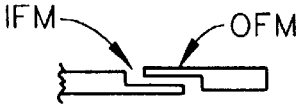
FIGS. 21*a* and 21*b* show an expanded view of mating portions of two present invention window frames as shown in FIG. 20.
Figure 21B:
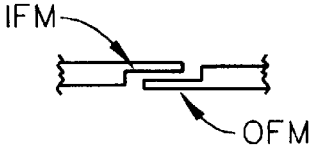

Turning now to FIG. 20, there are demonstrated, in cross-sectional side elevation, Inner (IF) and Outer (OF) Window Frames, as mounted to a Wall (W) of a building. Shown are Inner Window Sash Systems (IWA) and (IWB) and Outer Window Sash Systems (OWA) and (OWB) present respectively in said Inner (IF) and Outer (OF) preferred present invention Window Frames. FIGS. 21*a* and 21*b* demonstrate that in use facing analogically similar points of Inner (IF) and Outer (OF) preferred present invention Window Frames, are slideably interconnected by Mating Elements (IFM) and (OFM) respectively, (note (IFM) and (OFM) are also shown in FIG. 20), slide together to provide a complete preferred present invention Window Frame System, mounted in Wall (W). It will be noted in FIGS. 22*a* and 23*a,* (see supra), that it is preferable to utilize the configuration of FIG. 21*b,* as during installation, foam insulation (FI), (see FIGS. 22*a* through 23*b*), will typically be applied around the Outer Window Frame (OF) and will block access to a Mating Element (IFM) on Inner Window Frame (IF) once it hardens. However, if an Inner Window Frame (IF) can be installed while said Foam Insulation (FI) is still soft, a firm bonding of the Inner and Outer Window Frames can be effected thereby, where the configuration of FIG. 21*a,* as demonstrated in FIG. 20, is utilized.

Figure 22A:
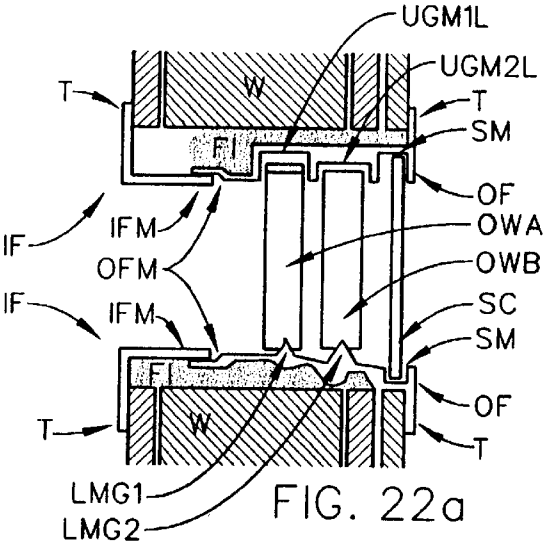
FIGS. 22*a* and 22*b* show front elevational cross-section, and top cross-sectional views of a present invention window frame system in which only an outer window frame contains window sash systems.
Figure 22B:
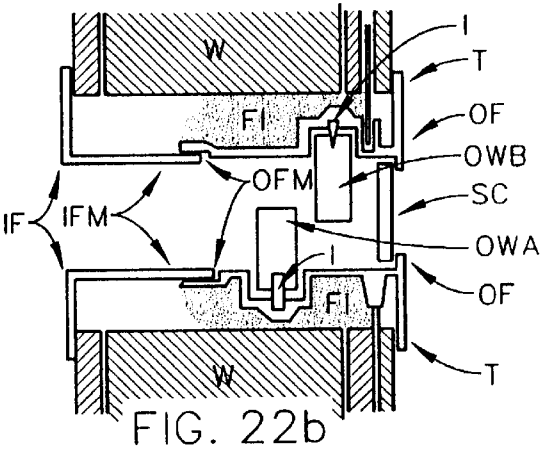

Turning now to FIGS. 22*a* and 22*b,* there are shown side elevational and top cross sectional views of a preferred present invention Window Frame System in which only the Outer Window Frame (OF) contains Window Sash Systems (OWA) & (OWB). The Inner Window Frame (IF) is shown to comprise Trim (T) and Mating Elements (IFM), whereas Outer Window Frame (OF) is shown to additionally comprise First and Second Upper Guide Means (shown are (UGM1L) & (UGM2L), and First and Second Lower Guide Means (LMG1) & (LMG2), with Outer Window Sash Systems (OWA) & (OWB) present therein respectively. Shown as well are Screen Retaining Means (SM) with a Screen (SC) present therein. Note that Mating elements (IFM) and (OFM) of the Inner and Outer preferred present invention Window Frames (IF) & (OF) are shown to slideably contact one another at a location within the region between the outer and inner planes of the outer and inner wall surfaces where the Trim (T) makes contact therewith. (Note that Mating Elements were generally shown as (M) in FIGS. 18*a* through 18*j*). This slideable contact between Mating Elements ((IFM) & (OFM) allows easy adjustment of Inner (IF) and Outer (OF) Window Frames during installation so that Trim (T) on each can be simultaneously positioned flush to said Inner and Outer Wall Surfaces as shown.

It is also noted, by reference to FIGS. 22*a,* 23*a* and 18*ga* and 18*gb,* that the First and Second Lower Guide Means (LMG1) & (LMG2) are of different vertical projecting lengths, and that Outer Window Sash Systems (OWA) & (OWB) are both of the same overall size. This use of different First and Second Lower Guide Means (LMG1) & (LMG2) lengths to allow both Outer Window Sash Systems (OWA) & (OWB) to be of the same vertical height is believed to be novel. As well, FIGS. 22*a* and 23*a* show that the Mating elements (IFM) and (OFM) of the Inner and Outer preferred present invention Window Frames (IF) & (OF) which slideably contact one another at a location within the region between the outer and inner planes of the outer and inner wall surfaces, can be extended beyond what is shown in FIGS. 18*ga* and 18*gb,* and be of slightly different shape. Said extension provides a relatively horizontal portion, in addition to a downward sloping section, as viewed in cross-section. This configuration can be termed a "Partially Downward Sloping" embodiment of the Outer Window Frame.

Figure 23B:
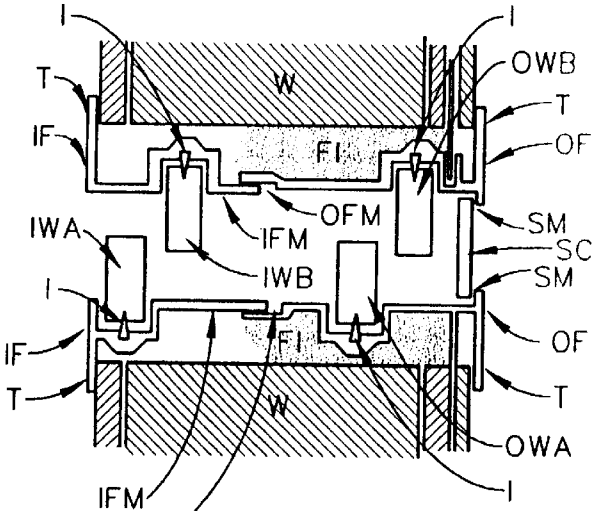
FIGS. 23*a* and 23*b* show front elevational cross-section, and top cross-sectional views of a present invention window frame system in which both inner and outer window frames contains window sash systems.
Figure 23A:
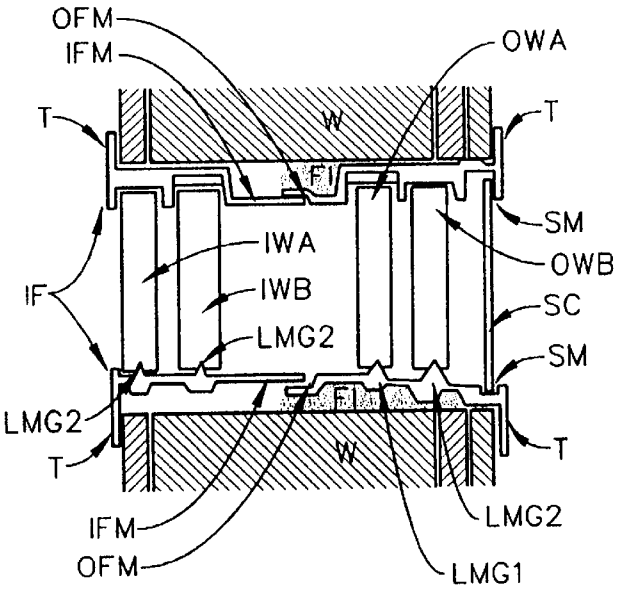

Turning now to FIGS. 23*a* and 23*b* there are shown side elevational and top cross sectional views respectively of a preferred present invention window frame system much as were shown in FIGS. 22*a* and 22*b,* but with said Inner Window Frame (IF) also providing means for containing Window Sash Systems (IWA) & (IWB). Other than the presence of an Inner Window Frame (IF) which supports the presence of Window Sash Systems (IWA) & (IWB), FIGS. 23*a* and 23*b* are essentially the same as FIGS. 22*a* and 22*b.* It is to be noted that the configuration of FIGS. 22*a* and 22*b* will typically be utilized where a Wall (WE) is of two (2) by four (4) inch construction, but that the configuration of FIGS. 23*a* and 23*b* will be applied where a Wall (W) is of two (2) by six (6) inch construction.

It is to be understood that preferred present invention Inner and Outer Window Frames can have different depths which are selected to match specific Building Wall requirements. For instance, a Building Wall which is only four (4) inches thick, will require a preferred present invention Outside Window Frame which provides outward projecting depth, (such as demonstrated by FIG. 18*gb*), sufficient to allow the presence of two window Sash Systems therein, (it such is desired), while simultaneously allowing Trim to contact the outer surface of said Building Wall. A six inch deep Building Wall will require a somewhat different preferred present invention Outer Window Frame Trim configuration, as demonstrated by FIG. 18*ga.* Use of an Inner Window Frame (IWF) as demonstrated in FIG. 18*j,* however, can be used in a four (4) inch deep wall, as shown in FIG. 22*a.* It is to be noted, however, that in any of said variations, that the basics of the preferred present invention Window Frames as described above remain unchanged.

It is also to be noted that FIGS. 22*a* and 23*a* show Window Frame Cross-Sectionals much as demonstrated by FIG. 18*ga,* in which the Bottom Sill is generally horizontally oriented, but presents with a downward slope in said Cross-Section. The Cross-Section in FIGS. 22*a* and 23*a* being observed from a left side in FIG. 17, however.

It is also to be noted that Foam Insulation (FI), (indicated as a multiplicity of dots), is shown present around the Outer Window Frame (OF) in FIGS. 22*a* through 23*b.* It is to be appreciated that the installation Procedure allows for easy application thereof after said Outer Window Frame (OF) is in place, but prior to placing Inner Window Frame (IF) into place. This provides a much better insulating result than is achieved by use of Glass Wool or other Compressible Insulation, as is generally used in conventional practice. This method of installation provides great utility, and is a method of use of the preferred present invention Window Frame System. In more detail said method comprises the steps of providing a preferred present invention Outer Window Frame System, installing it in a wall of a building or house or the like, applying insulating foam therearound, and installing a preferred present invention Inner Window Frame.

It is to be generally understood that a preferred present invention Window Frame is of Single-Piece construction, preferably being the result of a resin transfer molding process in which a heat catalized resin is forced into a mold and then exposed to heat. It is particularly important to understand that said process allows fabrication of structurally sound One-Piece preferred present invention Window Frames, which demonstrate high corner strength, without the necessity that said preferred present invention Window Frames be bulky.

Finally, in use, said preferred present invention Window Frames (IF) & (OF) will be typically mounted to a building or house or the like, (assumed equivalent for the purposes of this Disclosure), by nails or screws, with the Outer Window Frame (OF) also secured in place with injected expandable foam.

Having hereby disclosed the subject matter of the present invention, it should be obvious that many modifications, substitutions, and variations of the present invention are possible in light thereof. It is therefore to be understood that the present invention can be practiced other than as specifically described, and should be limited in breadth and scope only by the Claims.

I claim:

1. A window sash frame system comprising:

at least one window pane;

a window sash frame; and at least one interface means;

said window sash frame having essentially planar inner and outer surfaces comprising a width dimension parallel to said essentially planar inner and outer surfaces, and a depth dimension perpendicular thereto; said inner surface having at least one window pane receiving groove with said at least one window pane received therewithin; said window sash frame further having a groove means projecting into said essentially planar outer surface, said groove means being substantially a tapering "V" shape in cross section adjacent to said essentially planar outer surface and approaching convergence spaced from said essentially planar outer surface; said at least one interface means comprising a rigid insertional lip which is inserted into said groove means.

2. The window sash frame system as in claim 1, in which said window sash frame is made of extruded thermoplastic and said at least one window pane is secured in said window sash frame with silicone adhesive.

3. The window sash frame system as in claim 1, in which said at least one interface means comprises said rigid insertional lip, and a groove means comprising a substantially tapering "V" shape in cross-section, said interface means groove means being slideably mateable with a matching "V" cross sectional shape guide means.

4. The window sash frame system as in claim 1, in which said at least one interface means comprises a guide means having an elongated tapering cross-sectional shape, said guide means slideably contacting inner walls of said groove means beyond the cross-sectional substantially tapering "V" shape thereof, said elongated tapering cross-sectional shape guide means being said rigid insertional lip.

5. The window sash frame system as in claim 1, in which said at least one interface means comprises said rigid insertional lip, a hinge means, and a projecting element.

6. The window sash frame system as in claim 1, in which said at least one interface means comprises said rigid insertional lip, and an element perpendicularly oriented with respect thereto, said perpendicularly oriented element having ends extending beyond the width dimension of said window sash frame on opposite sides of said rigid insertional lip.

7. The window sash frame system as in claim 6, in which said perpendicularly oriented element has seal mounting means present on one of said ends thereof which extends beyond the width dimension of said window sash frame, such that a seal means mounted in said seal mounting means can interact with a similar seal means mounted in a similar seal mounting means present on a second window sash frame system, and thereby effect a weather-tight interconnection between said window sash frame systems.

8. The window sash frame system as in claim 6, in which said perpendicularly oriented element has weather seal mounting means present on said ends thereof which extend beyond the width dimension of said window sash frame.

9. The window sash frame system as in claim 1, in which said at least one interface means comprises said rigid insertional lip and two arcuate shaped projecting elements affixed thereto, each of said arcuate shaped elements projecting beyond the width dimension of said window sash frame, on opposite sides of said rigid insertional lip.

10. The window sash frame system as in claim 1, in which said at least one interface means comprises said rigid insertional lip, and a fork shaped element comprising two separated projections, such that said two separated projections can sandwich a fin, and thereby effect a weather tight seal therewith.

11. The window sash frame system as in claim 1, in which said at least one interface means comprises said rigid insertional lip rigidly interconnected to a second oppositely directed rigid insertional lip, such that said interface means can join two window sash frame systems together by said rigid insertional lip being inserted in said groove means of one of said window sash frame systems and by the second oppositely directed rigid insertional lip being inserted in the groove means of the other of said window sash frame systems.

12. The window sash frame system as in claim 11, in which said at least one interface means further comprises a perpendicularly oriented element having ends extending beyond the width dimension of said window sash frame on sides of said rigid insertional lip, said perpendicularly oriented element having a cap element affixed at one end thereof such that said cap element contacts an outer surface of an interconnected window sash frame.

13. The window sash frame system as in claim 1 comprising two window panes, said two window panes being secured in said window sash frame in two of said grooves which project from said essentially planar inner surface toward said essentially planar outer surface, such that a plane of the groove means projecting perpendicularly from said essentially planar outer surface toward said essentially planar inner surface, is oriented in the window sash frame between planes of said two window panes.

14. The window sash frame system as in claim 11, in which said interface means comprises a guide means having a matching "V" cross-sectional shape, said guide means slideably mating with said substantially tapering "V" shaped groove means in said window sash frame, said matching "V" shape guide means being the rigid insertional lip.

15. The window sash frame system as in claim 1, which comprises four sides and is essentially rectangular as viewed in frontal elevation.

16. A window sash frame containing at least one window pane, said window sash frame comprising, in an outer edge thereof, a groove means projecting thereinto, said groove means being of a tapering shape approaching convergence spaced from said outer edge, for slidably mating to a "V" shaped guide means, said window sash frame further comprising at least one interface means, said at least one interface means comprising a rigid insertional lip which is inserted into said groove means.

17. The window sash frame as in claim 16 in which the groove means, beyond said groove means tapering shape adjacent to said outer edge thereof, has a shape selected from the group consisting of:

essentially straight parallel walled, essentially straight parallel walled with depressions, essentially straight tapering walled, and essentially sawtooth shape walled.

18. The window sash frame as in claim 16 in which the rigid insertional lip is a "V" shaped guide means.

19. The window sash frame as in claim 16, in which said window sash frame is made of extruded thermoplastic and said at least one window pane is secured in said window sash frame with silicone adhesive.

20. A window sash frame system comprising:

at least one window pane;

a window sash frame; and at least one interface means;

said window sash frame having inner and outer surfaces comprising a width dimension and a depth dimension perpendicular thereto; said window sash frame having a groove means projecting into said outer surface, said groove means being a tapering shape in cross section and approaching convergence spaced from said outer surface; said at least one interface means comprising a rigid insertional lip which is inserted into said groove means; said at least one interface means comprising a selection from the group consisting of:

a. said rigid insertional lip, and a groove means comprising a tapering shape in cross-section, said interface means groove means being slideably mateable with a matching tapering cross-sectional shape guide means;

b. a guide means having an elongated tapering cross-sectional shape, said guide means slideably contacting inner walls of said groove means beyond the cross-sectional tapering shape thereof, said elongated tapering cross-sectional shape guide means being said rigid insertional lip;

c. said rigid insertional lip, a hinge means, and a projecting element;

d. said rigid insertional lip, and an element perpendicularly oriented with respect thereto, said perpendicularly oriented element having ends extending beyond the width dimension of said window sash frame system on opposite sides of said rigid insertional lip;

e. said rigid insertional lip, and an element perpendicularly oriented with respect thereto, said perpendicularly oriented element having ends extending beyond the width dimension of said window sash frame system on opposite sides of said rigid insertional lip, said perpendicularly oriented element having seal mounting means present on one of said ends thereof which extends beyond the width dimension of said window sash frame, such that a seal means mounted in said seal mounting means can interact with a similar seal means mounted in a similar seal mounting means present on a second window sash frame system, and thereby effect a weather-tight interconnection between said window sash frame systems;

f. said rigid insertional lip, and an element perpendicularly oriented with respect thereto, said perpendicularly oriented element having ends extending beyond the width dimension of said window sash frame system on opposite sides of said rigid insertional lip, in which said perpendicularly oriented element has weather seal mounting means present on said ends thereof which extend beyond the width dimension of said window sash frame;

g. said rigid insertional lip and two arcuate shaped projecting elements affixed thereto, each of said arcuate shaped elements projecting beyond the width dimension of said window sash frame, on opposite sides of said rigid insertional lip;

h. said rigid insertional lip, and a fork shaped element comprising two separated projections, such that said two separated projections can sandwich a fin, and thereby effect a weather tight seal therewith;

i. said rigid insertional lip rigidly interconnected to a second oppositely directed rigid insertional lip, such that said interface means can join two window sash frame systems together by said rigid insertional lip being inserted in said groove means of one of said window sash frame systems and by the second oppositely directed rigid insertional lip being inserted in groove means of the other of said window sash frame systems;

j. said rigid insertional lip rigidly interconnected to a second oppositely directed rigid insertional lip, such that said interface means can join two window sash frame systems together by said rigid insertional lip being inserted in said groove means of one of said window sash frame systems and by the second oppositely directed rigid insertional lip being inserted in groove means of the other of said window sash frame systems, in which said at least one interface means further comprises a perpendicularly oriented element having ends extending beyond the width dimension of said window sash frame on sides of said rigid insertional lip, said perpendicularly oriented element having a cap element affixed at one end thereof such that said cap element contacts an outer surface of an interconnected window sash frame system;

k. a guide means having a matching tapering cross-sectional shape, said guide means slideably mating with said tapering shaped groove means in said window sash frame, said matching tapering shape guide means being the rigid insertional lip.

21. The window sash frame system as in claim 20, in which said window sash frame is made of extruded thermoplastic and said at least one window pane is secured in said window sash frame with silicone adhesive.

* * * * *